US011781453B2

(12) United States Patent
Otani et al.

(10) Patent No.: US 11,781,453 B2
(45) Date of Patent: Oct. 10, 2023

(54) INTERNAL COMBUSTION ENGINE

(71) Applicant: NISSAN MOTOR CO., LTD., Yokohama (JP)

(72) Inventors: Masayuki Otani, Kanagawa (JP); Nobuhiko Satou, Kanagawa (JP)

(73) Assignee: NISSAN MOTOR CO., LTD., Yokohama (JP)

( * ) Notice: Subject to any disclaimer, the term of this patent is extended or adjusted under 35 U.S.C. 154(b) by 298 days.

(21) Appl. No.: 17/426,784

(22) PCT Filed: Feb. 1, 2019

(86) PCT No.: PCT/JP2019/003682
§ 371 (c)(1),
(2) Date: Jul. 29, 2021

(87) PCT Pub. No.: WO2020/157970
PCT Pub. Date: Aug. 6, 2020

(65) Prior Publication Data

US 2022/0127981 A1 Apr. 28, 2022

(51) Int. Cl.
*F01M 9/08* (2006.01)
*F01M 9/10* (2006.01)
*F01M 11/02* (2006.01)

(52) U.S. Cl.
CPC ..... *F01M 9/08* (2013.01); *F01M 9/105* (2013.01); *F01M 9/106* (2013.01); *F01M 9/108* (2013.01); *F01M 11/02* (2013.01); *F01M 2011/023* (2013.01)

(58) Field of Classification Search
CPC ..... F01M 9/08; F01M 9/105
See application file for complete search history.

(56) References Cited

U.S. PATENT DOCUMENTS 4,771,745 A * 9/1988 Nakamura ..... F01M 13/00 123/196 R
2020/0291834 A1* 9/2020 Koyama ..... F01L 1/053

FOREIGN PATENT DOCUMENTS

| | | | | |
|---|---|---|---|---|
| EP | 1722075 | A1 * | 11/2006 | F01L 1/0532 |
| JP | 62-99607 | A | 5/1987 | |
| JP | 04-66307 | U | 6/1992 | |
| JP | 2013-113276 | A | 6/2013 | |
| JP | 2014-218936 | A | 11/2014 | |
| JP | 2015094240 | A * | 5/2015 | F01L 1/02 |
| JP | 2018162775 | A * | 10/2018 | |
| JP | 2018-178832 | A | 11/2018 | |

* cited by examiner

*Primary Examiner* — Ngoc T Nguyen
(74) *Attorney, Agent, or Firm* — Foley & Lardner LLP

(57) ABSTRACT

Provided is an internal combustion engine having an oil circulating structure wherein oil used to lubricate valve operating members in the cylinder head drops onto an oil pan, and the oil accumulated therein is drawn up to the cylinder head again. Each on corners of the squire bottom face inside the cylinder head of the internal combustion engine, an oil dropping hole is provided to allow the oil used to lubricate valve operating members to flow thereinto. Also provided is an oil channel communicating with one or more of the oil dropping hole at the bottom thereof to guide the oil toward the driving gear transmitting the driving force of the engine.

6 Claims, 5 Drawing Sheets

INTERNAL COMBUSTION ENGINE

TECHNICAL FIELD

The present invention relates to an internal combustion engine.

BACKGROUND ART

In general, inside the cylinder head of an internal combustion engine, lubrication oil is supplied to a valve operating member, such as an intake valve and an exhaust valve, and the supplied oil flows into an oil dropping hole provided inside in the cylinder head. After flowing into the oil dropping hole, the lubrication oil flows down through the cylinder block located in the base part of the cylinder head and finally drops onto an oil pan. The lubrication oil accumulated in the oil pan is then pumped up by a pump and returned to the cylinder head for circulation. (for example, JPS62-99607A)

SUMMARY OF INVENTION

Let us consider an engine mounted on a vehicle, wherein the oil dropping hole is provided in the vicinity of the sides of the cylinder head as shown in JPS62-99607A. In such a configuration, traveling conditions of the vehicle such as acceleration and deceleration can cause biasing in the distribution of the oil accumulated in the base part of the cylinder head, hindering a smooth flow of the oil into the oil dropping hole. As a result, if the oil flowing into the oil dropping hole is to be used for lubrication purpose of a member such as a gear, shortage of lubrication may occur.

An object of this invention is to facilitate the flow of lubrication oil into the oil dropping hole to suppress a shortage in the lubrication oil of the member such as a gear.

In an aspect of this invention, an internal combustion engine provides an oil circulation structure that allows the oil used to lubricate the valve operating members inside the cylinder head to drop onto an oil pan and then pumps up the oil in the oil pan to the cylinder head. Each on at least two corners of the squire bottom face of the engine's cylinder head, an oil dropping hole is provided to allow the oil used to lubricate valve operating members to flow thereinto. Also provided is an oil channel communicating with one or more of the oil dropping hole at the bottom thereof to guide the oil toward the driving gear transmitting a driving force of the engine.

DESCRIPTION OF EMBODIMENTS

In the following paragraphs, the engines of each embodiment are described referring to the figures.

First Embodiment

Figure 1:
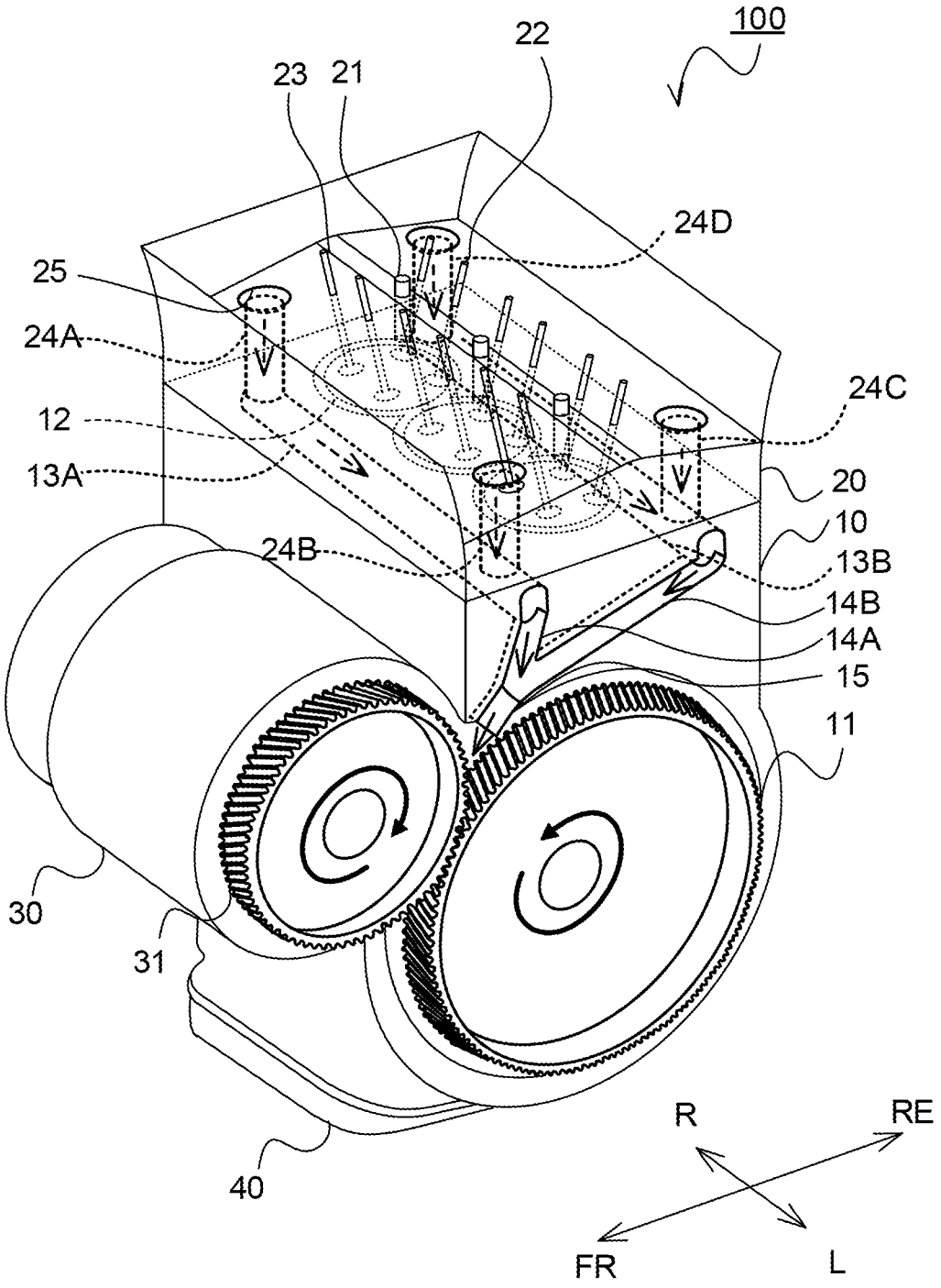
FIG. 1 shows a perspective view of the engine of the first embodiment.

FIG. 1 shows a perspective view of the internal combustion engine 100 of the first embodiment.

The internal combustion engine 100 consists of its main body having a cylinder block 10 and an cylinder head 20, and, additionally a generator 30. In the following descriptions, the internal combustion engine 100 is referred simply to as the engine 100. The engine 100 is generally mounted on a vehicle, wherein the engine 100 provides driving power to the generator 30 whose output may be supplied to batteries and motors (not shown in the figure). The output from the generator 30 can also be used for motoring the engine 100.

The cylinder block 10 has a crankshaft having a driving gear 11 on its end, and the generator 30 has a transmission gear 31 on the end of the rotor shaft. These two gears—the driving gear 11 and the transmission gear 31—are configured to engage each other. This configuration enables the rotational driving force generated by the engine 100 to be transmitted to the generator 30 through the driving gear 11 and the transmission gear 31. Note that a cover (not shown in the figure) is provided to enclose the driving gear 11 and the transmission gear 31, and the entirety of these three elements (the drive gear 11, transmission gear 31 and cover) is called a gear box. Under the cylinder block 10, an oil pan 40 is provided.

The engaged portion of the driving gear 11 and the transmission gear 31 moves in a direction away from the cylinder head as the two gears rotate. In other words, while the generator 30 is generating power driven by the engine 100 (typically while the vehicle is running), the driving gear 11 rotates counterclockwise, and the transmission gear 31 clockwise (see the figure).

In this figure, the direction from the left front to the right deep, or parallel with the juxtaposition of the cylinder block 10 and the generator 30, indicates the moving direction of the vehicle: the generator 30 is placed on the front side of the vehicle (FR, left front in the figure) and the cylinder block 10 on the rear side (RE, right deep in the figure). In other words, the generator 30 is placed at the forward side of vehicle (FR) in relation to the adjacent cylinder block 10. The crankshaft of the engine 100 and the rotor shaft of the generator 30 are aligned with the width direction of the vehicle: i.e., the deep left direction in the figure indicates the right side (R) and the right front indicates the left side (L) of the vehicle.

A plurality of cylinders 12 (three in this figure, each having a piston inside) is provided in the cylinder block 10. The cylinders 12 are arranged in the right-to-left direction of the vehicle. Therefore, the right-to-left direction is also called the cylinder arrangement direction. The cylinder 12 includes a spark plug 21 igniting the fuel gas inside the cylinder 12, an intake valve 22 controlling the air intake, and an exhaust valve 23 controlling the exhaust gas.

Repetitive sequence of events inside the cylinder 12—intake of air-fuel mixed gas, compression, combustion, and exhaust—are realized by controlling the ignition plug 21, intake valve 22, and exhaust valve 23, causing the piston to move reciprocally inside the cylinder 12. The bottom end of the piston connection rod is connected with the crankshaft to covert the up-down reciprocating movement of the piston to rotary movement of the crankshaft. The driving gear 11, connected to the end of the crankshaft, is thus rotationally driven.

The cylinder head 20 is arranged on top of the cylinder block 10 and has a shape that becomes wider in a short dimension direction (front-rear direction of the vehicle) as it goes up. In this embodiment, each cylinder 12 has an ignition plug 21, two intake valves 22, and two exhaust valves 23. Valve members such as the intake valve 22 and exhaust valve 23 are generally slidably composed, and are referred to as valve operating members.

The intake valve 22 and the exhaust valve 23 are connected to the camshaft included in the cylinder head 20, and the air intake port and the exhaust port perform opening and closing operations as the rotation axis of each camshaft is rotationally driven by the crankshaft. The combustion inside the cylinder 12 is controlled by up-and-down reciprocal movements of the air intake valve 22 and exhaust valve 23 synchronously driven by the rotation of the camshaft. The controlled combustion causes the piston to move up and down inside the cylinder 12, and this reciprocal vertical movement rotates the crankshaft and the driving gear 11, whose rotational driving force is transmitted to the generator 30 via the transmission gear 31.

Inside the cylinder head 20, oil is provided to lubricate sliding portions of the valve operating members such as the intake valve 22 and exhaust valve 23. The supplied oil, after flowing inside the cylinder block 10, drops down and stored in the oil pan 40 arranged in the bottom part of the cylinder block 10. The oil accumulated in the oil pan 40 is pumped up by a pump (not shown in the figure) to the cylinder head 20 and provided to the valve operating members again. In this way, an oil circulation system is configured inside the engine 100.

Figure 2:
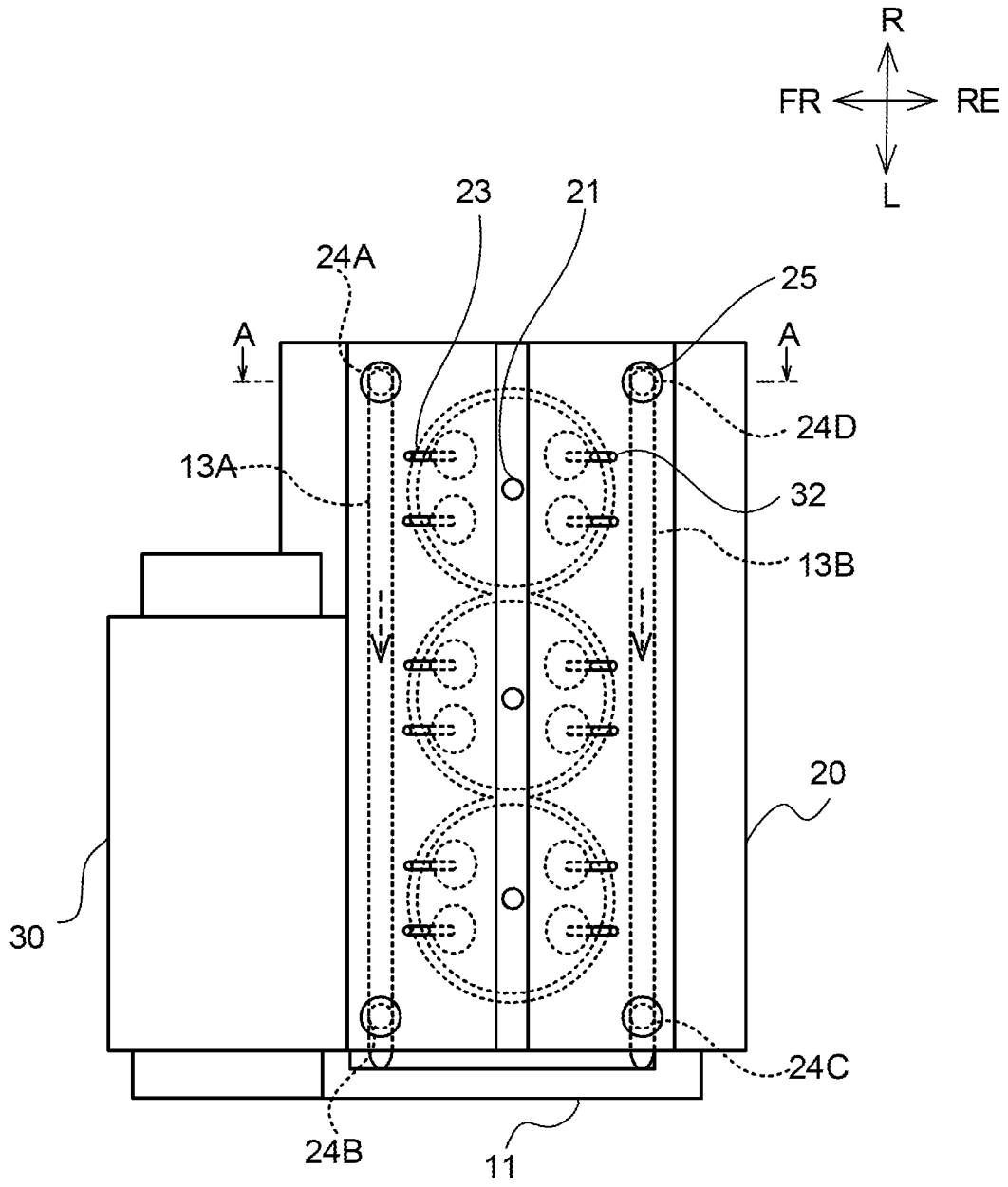
FIG. 2 is a top view of the cylinder head shown in FIG. 1.
Figure 3:
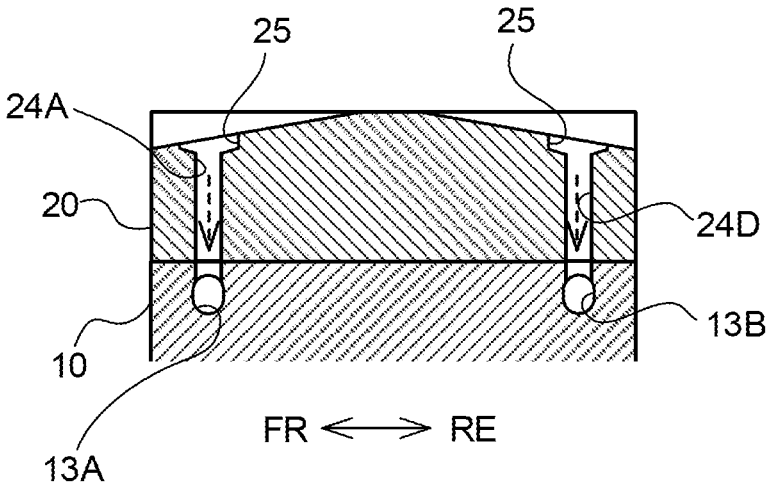
FIG. 3 shows a top view of the A-A cross section of the cylinder head of FIG. 2.

In the following paragraphs, the details of oil passages in the cylinder block 10 and cylinder head 20 are described. FIG. 2 is a top view of the engine 100 shown in FIG. 1, and FIG. 3 shows a A-A' cross-section of FIG. 2. In FIG. 2, upper direction indicates the right side (R), right direction the rear side (RE), down direction the left side (L), and left direction the front side (FR) of the vehicle respectively. In FIG. 3, right direction of the figure indicates the rear side (RE) and left direction the front side (FR) of the vehicle respectively.

As shown in FIG. 2, the base part of the cylinder head 20 is constructed to have roughly rectangular shape (in plain view) with four oil dropping holes 24A-24D, one on each of four corners, into which the oil supplied to the valve operating members flows. As shown in FIG. 3, the oil dropping holes 24A-24D are arranged to extend vertically downward.

Among the oil dropping holes 24 (24A to 24D), the oil dropping hole 24 located on the opposite side of the driving gear 11 (right side of the vehicle: R) and on the side of the generator 30 (front side of the vehicle: FR) is named as the dropping hole 24A. One of the oil dropping holes 24 located on the side of the driving gear 11 (left side of the vehicle: L) and on the side of the generator 30 (FR) is named as the dropping hole 24B. Another one of the oil dropping holes 24 located on the side of the driving gear 11 (L) and on the opposite side of the generator 30 (FR) is named as the dropping hole 24C. Yet another one of the oil dropping holes 24 located on the opposite side of the driving gear 11 (R) and on the opposite side of the generator 30 (RE) is named as the dropping hole 24D.

On the bottom face of the cylinder head 20, a circular cross-sectional recess (oil reservoirs 25) with a larger diameter than that of the oil dropping holes 24 is made to the upper most part of each of the oil dropping holes 24A to 24D. Note that the cross-sectional shape of the oil reservoir 25 is not limited to a circular shape, but may be any shapes including a rectangle.

Inside the cylinder block 10, two oil channels (a first oil channel 13A and a first oil channel 13B) are formed and extend in the cylinder arrangement direction (R-L direction) arranged parallely opposite to each other with the cylinder 12 interposed inbetween. The first oil channel 13 located to the generator 30 side (FR) is named as the first oil channel 13A, and the other one opposite to the generator 30 (RE) is named as the first channel 13B. In both of the oil channels (the first oil channel 13A and 13B), the oil flows in the direction toward the driving gear 11 (L).

The first oil channel 13A has two connecting portions on its upper part at both ends along its length in the cylinder arrangement direction to communicate with the bottom end of the oil dropping holes 24A and 24B. The first oil channel 13A is arranged to have a downward inclination along the cylinder arrangement direction, from the communicating point with the oil dropping hole 24A to that with the oil dropping hole 24B, toward the driving gear 11 (L). The downward inclination of the first oil channel 13A has an effect of guiding the oil that is flowing into the oil dropping hole 24A toward the driving gear 11 (L). Further, the oil flowing into the oil dropping hole 24B joins with the oil flow from the first oil channel 13A in the vicinity of the driving gear 11.

In the same fashion, the first oil channel 13B has two connecting portions at both ends of its length along the cylinder arrangement direction to communicates with the bottom ends of the oil dropping holes 24C and 24D. The first oil channel 13B is arranged to have a downward inclination along the direction (L) toward the driving gear 11. The oil flowing into the oil dropping hole 24D enters into the first oil channel 13B and is guided toward the driving gear 11 (L). This oil flow joins with that from the oil dropping hole 24C in the vicinity of the driving gear 11.

As shown in FIG. 1, the first oil channels 13A and 13B are connected to the second oil channels 14A and 14B respectively at the driving gear 11 side end of the channels. The second oil channels 14A, 14B are arranged to run, starting from each connecting part with the first oil channels 13A and 13B, toward the engaging portion between the driving gear 11 and the transmission gear 31, and converges in front of the engaging portion. An additional channel (the third oil channel 15) is arranged to receive the total flow of oil to the downstream of the converging point with a discharge opening directed to the engaging portion between the driving gear 11 and the transmission gear 31.

The configuration described above enables the oil flowing into the oil dropping holes (24A to 24D) to flow inside the cylinder block 10 to the engaging portion between the driving gear 11 and the transmission gear 31 via the first oil channels (13A or 13B) and the second oil channels (14A or 14B) and further through the third oil channel 15. From the discharge opening of the third oil channel 15, the oil finally drops onto the engaging portion between the driving gear 11 and the transmission gear 31 for lubricating these gears. After being used to lubricate the driving gear 11 and the transmission gear 31, the oil is led from the bottom of the gear box to the oil pan 40.

The oil channels (the first oil channels 13A and 13B, the second oil channels 14A and 14B, and the third oil channel 15) may be integrally formed within the cylinder block using the molding techniques (casting emission), or configured by arranging pipe members inside the cylinder block 10 and cylinder head 20. The embodiment described here is an example wherein the oil channels 13-15 are formed in the cylinder block 10, and the oil dropping holes 24 are formed in the cylinder head 20. However, the system arrangement is not limited to this configuration: the oil channels 13-15 and the oil dropping holes 24 may be formed either in the cylinder block 10, or in the cylinder head 20.

This embodiment represents an example wherein the driving gear 31 receiving the driving force of the driving gear 11 (i.e., the driving force of the engine 100) is mounted on the rotor shaft of the generator 30. However, this is not the only option: the transmission gear 31 may mounted on the driving shaft of any configurations including a transmission mechanism.

The engine 100 described in the first embodiment provides the following effects.

The engine 100 in the first embodiment has the oil dropping holes 24 for receiving the oil used to lubricate valve operating members, and they are located in the corners of the bottom face of the cylinder block 100. The oil flowing into the oil dropping holes 24 is guided, via the oil channels 13-15, to the driving gear 11 transmitting the drive force generated by the engine 11. Then the oil, after dropping onto the driving gear 11, is collected in the oil pan 40.

Depending on the traveling conditions of the vehicle on which the engine 100 is mounted, such as acceleration, deceleration and tilting of the vehicle, the oil provided to the engine head 20 may have a biased distribution on the bottom face thereof. Because the oil dropping hole 24 is arranged each on the four corners of the cylinder head 20, the oil on the bottom face of the cylinder head 20 is certain to flow into one of the oil dropping holes 24A to 24D even if the oil is unevenly distributed.

Concretely, while the vehicle is accelerating, the oil on the bottom section of the cylinder head 20 tends to distribute more heavily toward the rear of the vehicle (RE) and flows into the oil dropping holes 24C and 24D. While the vehicle is decelerating, the oil tends to distribute more heavily toward the front direction of the vehicle (FR) and flows into the oil dropping holes 24A and 24B. While the vehicle is turning to the right, the centrifugal force causes the oil to distribute more heavily on the left side (L) of the vehicle, and the oil biases to the left side of the vehicle flow into the oil dropping holes 24B and 24D. By the same token, while the vehicle is turning to the left, the oil tends to distribute more heavily to the right side of the vehicle (R), and the oil biases to the right side of the vehicle flows into the oil dropping holes 24A and 24D.

The oil that flows into the oil dropping holes 24 is guided, via the oil channels 13 to 15, to the driving gear 11 of the engine 100. In this way, the oil provided to the valve operating members inside the cylinder head 20 is supplied to the driving gear by way of the oil dropping holes 24 and the oil channels 13-15, ensuring to avoid occurrence of lubrication shortage in the driving gear 11.

As the oil used to lubricate the valve operating members inside the cylinder head 20 flows into the oil dropping holes 24 and then supplied to the driving gear 11, the oil circulating mechanism arranged in the cylinder head 20 also functions as the oil supplying means to the driving gear 11. Thus, this arrangement eliminates the needs to provide separate oil supplying system (pump, oil jet and others) for lubricating the driving gear 11, enabling to simplify the configuration of the engine 100.

Furthermore, as the oil supplied to the valve operating members of the cylinder head 20 has already been used to lubricate the valve operating members, the oil has an increased temperature and lowered viscosity. Thus, the oil produces an effect of further reducing friction in the driving gear 11 than the oil provided by a separately arranged oil supplying mechanism.

In the engine 100 of the first embodiment, an oil reservoir (25) communicating with the oil dropping holes 24 is arranged on the upper most portion of each of the oil dropping holes 24. The oil reservoirs 25 have a larger diameter that the diameters of the oil dropping holes 24. The oil flowing into these recessed portions (the oil reservoirs 25) stays there temporarily before being guided along the inner surface to the oil dropping holes 24 By providing these temporary oil storages, the oil reservoirs 25, on top of the oil dropping holes 24, the oil accumulated on the base portion of the cylinder head 20 is supplied more steadily to the driver gear 11 through the oil dropping holes 24.

According to the engine 100 of the first embodiment, the first oil channels 13A and 13B, both communicating with the lower end of the oil dropping holes 24, are arranged to have a downward inclination toward the driving gear 11. This arrangement enables the oil flowing into the oil dropping holes 24 to be guided toward the driving gear 11, providing a smooth supply of oil thereto. All these oil channels—the second oil channels 14A and 14B communicating with the first oil channels 13A and 13B, as well as the third oil channel 15 having the final discharge opening—are arranged to have a downward inclination toward the driving gear 11 ensuring smooth flow of oil to the driving gear 11.

According to the engine 100 of the first embodiment, the oil flowing into the oil dropping holes 24 finally exits from the discharging opening of the third oil channel 15 onto the portion where the driving gear 11 engages with the transmission gear 31. This arrangement allows simultaneous supply of the oil to the two gears—the driving gear 11 by which the driving force of the engine 100 is transmitted, and the transmission gear 31 of the generator 30 to which the driving force is transmitted—ensuring more surely to reduce friction between these two gears.

According to the engine 100 of the first embodiment, the driving gear 11 rotates in the direction where the engaging portion with the transmission gear 31 goes away from the cylinder head 20. In other words, the portion where the driving gear 11 and the transmission gear 31 engage each other moves in the direction away from the discharge opening (or the filler opening) of the third oil channel 15. In this way, the oil discharging out of the third oil channel 15 drops in the same direction with the rotation movements of the driving gear 11 and the transmission gear 31, effectively restraining splashes out of the direction toward these two gears.

The engine 100 in the first embodiment is integrally formed with the generator 30, and the driving gear 11 of the engine 100 engages the transmission gear 31 of the generator 30. This configuration enables size reduction of the engine 100 as a whole, due to possible sharing of the oil supplying structure of the two gears (driving gear 11 and the transmission gear 31) and the oil circulation structure of the in the engine 100.

(Variations)

So far, using the first embodiment as an example, the configuration with the oil dropping holes (24A to 24D) arranged one at each of four corners of the base part of the cylinder head 20 has been described. However, the preferred configuration is not limited to this. For example, even if the oil is not evenly distributed on the base part of the cylinder 20, three of more oil dropping holes 24 arranged at three or more corners of the base part of the cylinder 20 will suffice to flow the oil into the oil dropping holes 24.

As the first variation, the following arrangement in the cylinder head 20 is discussed: the oil dropping hole 24A is provided at the position opposite to the driving gear 11 and to the side of the generator 30 (R, FR); the oil dropping hole 24B to the side of the driving gear 11 and generator 30 (L, FR); and the oil dropping hole 24C to the side of the driving gear 11 and opposite to the generator 30 (L, RE).

In this arrangement, while the vehicle is accelerating, the oil is biased to the rear side of the vehicle (RE) and flows into the oil dropping hole 24C. By the same token, while the vehicle is decelerating, the oil is biases to the front side (FR) and flows into the oil dropping holes 24A and 24B, while the vehicle is turning to the right, the oil is biased to the left side (L) and flows into the oil dropping hole 24B, and while the vehicle is turning to the left, the oil is biased to the right side (R). and flows into the oil dropping hole 24A.

As described above, irrespective of the direction to which the oil is biased (front, rear, right and left of the vehicle), the oil flows into either one of the oil dropping holes (24A to 24C). Therefore, this configuration ensures stable supply of the oil to the driving gear 11, preventing the occurrence of lubrication shortage in the driving gear 11.

(Second Variation)

In the first embodiment, a configuration is described wherein the oil dropping hole 24 is arranged each on four corners (one in a corner) of the base part of the cylinder head 20. However, the preferred configuration is not limited to this. An arrangement may be used wherein only a fraction of the four base part corners is used to provide the oil dropping hole 24.

Figure 4:
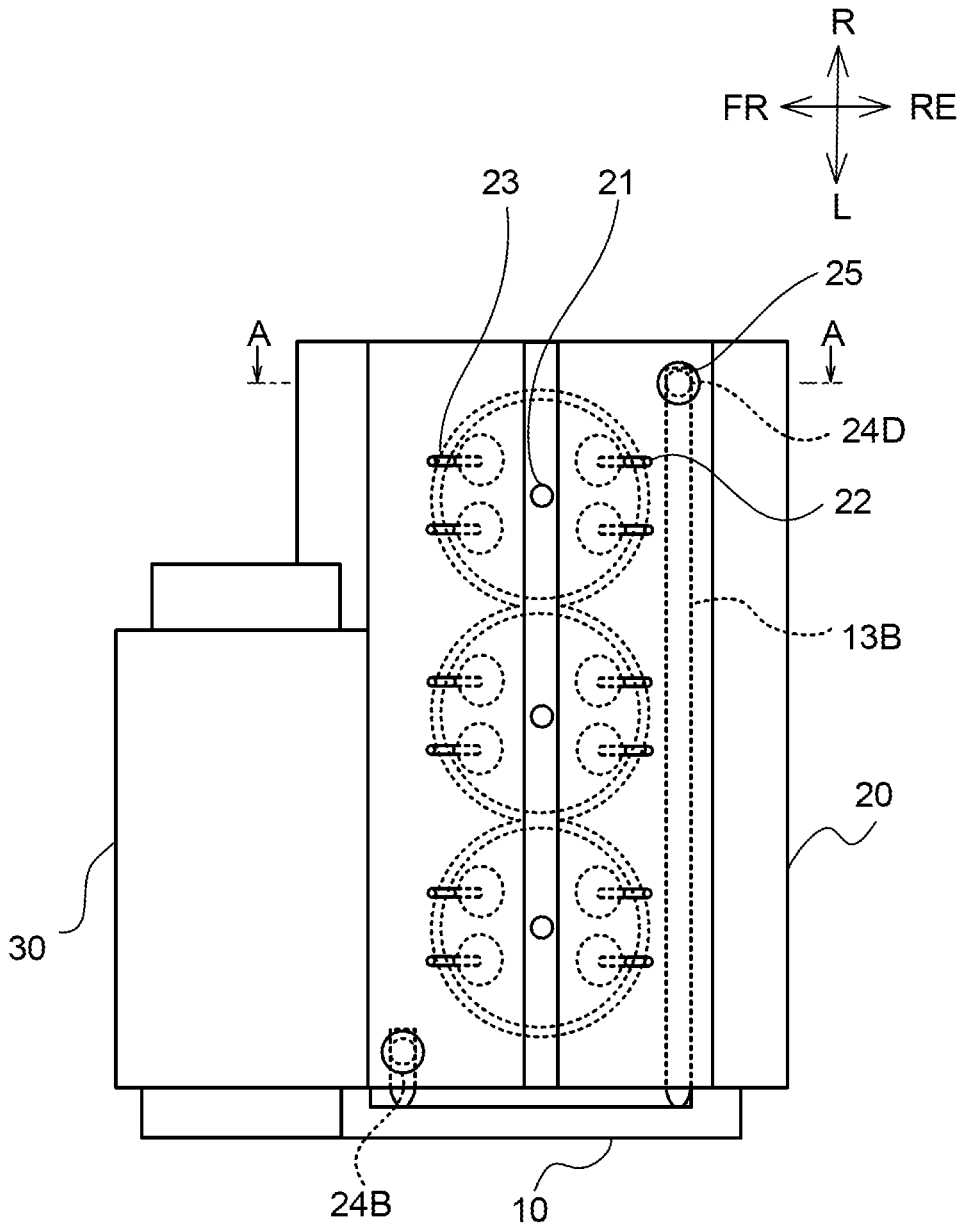
FIG. 4 shows a top view of the engine of the second embodiment.

FIG. 4 shows the top view of the cylinder head 20 of the second embodiment.

According to the figure, the following two oil dropping holes 24 are provided inside the cylinder head 20: the oil dropping hole 24B is arranged on the side of the driving gear 11 (L) and on the side of the generator 30 (FR), the oil dropping hole 24D is arranged on the opposite side of the driving gear 11 (R) and on the opposite side of the generator 30 (RE). Furthermore, the first oil channel 13B is provided in the cylinder block 10 in such an arrangement that it communicates with oil dropping hole 24D.

In this configuration, in comparison with that of the first embodiment, the oil dropping holes 24A and 24C are omitted, and the first oil channel 13A communicating with the oil dropping hole 24B has a shorter length. This configuration also allows the oil to flow into the oil dropping holes 24B and 24D, even if the distribution of the oil on the bottom face of the cylinder head 20 is biased due to the traveling conditions of the vehicle. As is shown in this embodiment, provision of the oil dropping holes 24 arranged on mutually diagonal corners of the bottom face of the cylinder 20 ensures the oil to flow into either one of the oil dropping holes 24 even if the distribution of the oil is biased.

The following effects can be obtained from the engine 100 in the second embodiment.

Two oil dropping holes 24B and 24D are provided at two mutually diagonally positioned corners out of the four corners on the bottom face of the cylinder head 20. This arrangement enables the oil to flow into the oil dropping holes 24B and 24D even when the oil on the bottom face of the cylinder head 20 is tilted due to traveling conditions of the vehicle.

The oil preferentially flows into the oil dropping hole 24D when the oil is biased to the rear side (RE) of the vehicle (i.e., while the vehicle is accelerating) or to the right side (R) of the vehicle (e.g., while the vehicle is turning to the left). By the same token, the oil preferentially flows into the oil dropping hole 24B when the oil is biased to the forward side (FR) of the vehicle (e.g., while the vehicle is decelerating) or to the left side (L) of the vehicle (i.e., the vehicle is turning to the right). The oil flowing into the oil dropping holes 24A and 24D is supplied, through the oil channels 13-15, to the driving gear 11.

Thus, the arrangement described above enables, as compared to the first embodiment, to omit the oil dropping holes 24A and 24C, resulting in simpler configuration of the engine 100. Furthermore, this arrangement maintains stable supply of the oil to the driving gear 11 even when the distribution of the oil is biased due to the traveling conditions of the vehicle/

(Variations)

In the second embodiment, a configuration of the cylinder head 10 is described in which the oil dropping holes 24B and 24D are arranged at diagonal positions to each other. However, the arrangement of oil dropping holes is not limited to this. Even if the two oil dropping holes 24 are not arranged at diagonal positions to each other, the flow of the oil into the dropping holes 24 is secured even if the oil distribution is biased, if the oil dropping holes 24 are provided on two or more corners of the base part of the cylinder head 20.

In the following paragraphs, as the second variation, an arrangement is discussed wherein the oil dropping hole 24A is provided on the position opposite to the drive gear 11 and on the side of the generator 30 (R, FR), and the oil dropping hole 24B provided on the side of the driving gear 11 and the generator 30 (L, FR).

In this arrangement, the oil biased to the vehicle's forward direction (FR, i.e. the vehicle is decelerating) flows int the oil dropping holes 24A and 24B. By the same token, the oil biased to the vehicle's right direction (R, the vehicle is turning to the left) flows into the oil dropping hole 24A, and the oil biased to the vehicle's left direction (L, the vehicle is turning to the right) flows into the oil dropping hole 24B.

As the third variation, the following arrangement in the cylinder 20 is discussed: the oil dropping hole 24B is provided on the side of the driving gear 11 and the generator 30 (L, FR), and the oil dropping hole 24C is provided on the position to the opposite to the driving gear 11 and to the opposite to the generator 30 (L, RE).

In this arrangement, the oil biased to the vehicle's left side (L, i.e., the vehicle is turning to the right) flows into the oil dropping holes 24B and 24C. By the same token, the oil biased to the vehicle's forward direction (FR, i.e., the vehicle is decelerating) flows into the oil dropping hole 24B, and the oil biased to the vehicle's rear direction (RE, i.e., the vehicle is accelerating) flows into the oil dropping hole 24C.

As shown in these examples, the oil on the bottom face of the cylinder 20, even if with biased distribution, flows into one or more of the oil dropping holes 24, resulting in stable supply of the oil to, and suppression of lubrication shortage in the driving gear 11.

Third Embodiment

In the first embodiment, a configuration is described wherein the second oil channels (14A and 14B) and the third oil channel (15) are arranged to the discharging end (driving gear 11 side) of the first oil channel 13A and 13B. However, the preferred configuration is not limited to this. In this embodiment, an arrangement is described wherein the second oil channels 14A, 14B and the third oil channel 15 are omitted.

Figure 5:
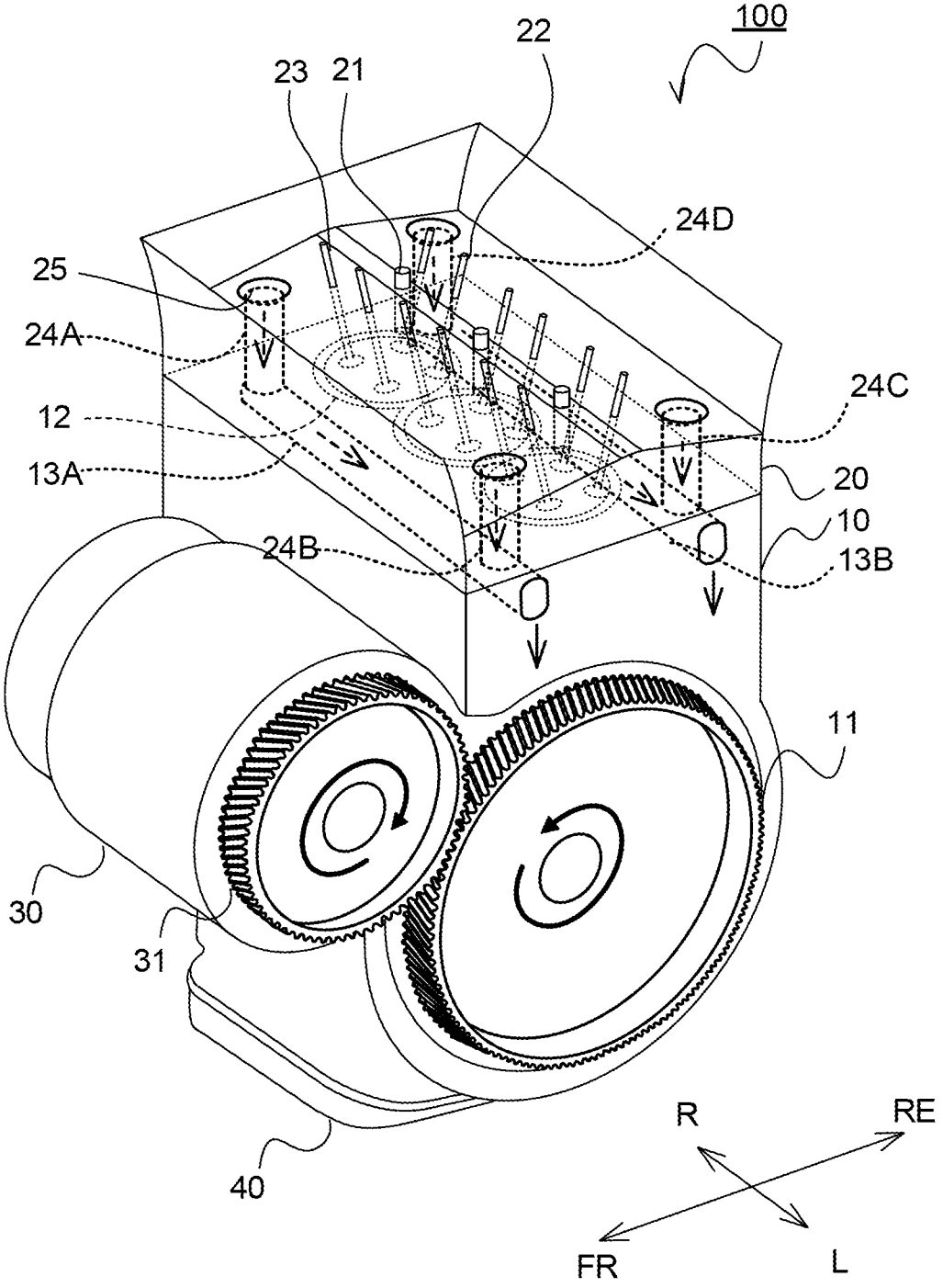
FIG. 5 shows a perspective view of the engine of the third embodiment.

FIG. 5 shows a perspective view of the engine 100 of the third embodiment. In comparison with the engine 100 of the first embodiment, the engine 100 of the third embodiment is characterized by the omission of the second oil channels 14A, 14B and the third oil channel 15. The discharging ends of the first oil channels 13A and 13B have openings above the driving gear 11. Thus, the oil exiting from the first oil channels 13A and 13B drop down onto the driving gear 11.

The following effects can be obtained from the engine 100 of the third embodiment.

Since the oil dropping holes 24A-24D are arranged on each of the four corners of the bottom face of the cylinder head 20, the oil flows into one or more of the dropping holes 24 even if the distribution of the oil is biased due to the traveling conditions of the vehicle. The first oil channels 13A, 13B communicating with the bottom ends of the oil dropping holes 24A-24D have opened ends above the driving gear 11. This configuration also allows the oil flowing into the oil dropping holes 24A-24D to be guided, through the first oil channels 13A and 13B, to the driving gear 11.

Therefore, this configuration ensures stable supply of the oil to the driving gear 11 even if the distribution of the oil is biased due to the traveling condition of the vehicle, and provides a merit of simpler construction of the engine 100, especially of the cylinder block 10.

In this specification, typical embodiments of the present invention are described, which should be considered to represent only some examples of the applications of the present invention and by no means limit the range of technical scope of the present invention to the specific configurations of these embodiments. In addition, it is to be noted that the above described embodiments can be appropriately combined. to the purpose.

The invention claimed is:

1. An internal combustion engine having an oil circulating structure for dropping oil onto an oil pan, the oil used to lubricate a valve operating member provided with a cylinder head, and drawing the oil accumulated in the oil pan up to the cylinder head again, comprising:

an oil dropping hole, into which the oil used to lubricate the valve operating member flows, is provided each on at least two corners of a square bottom face of the cylinder head, and an oil channel communicating with a bottom end of the oil dropping hole to guide the oil flowed into the oil channel to a driving gear, which transmits a driving force of the internal combustion engine, wherein the oil dropping hole is provided at two of the corners which are mutually diagonal.

2. The internal combustion engine according to claim 1, further comprising an oil reservoir above the oil dropping hole on a bottom face of the cylinder head, the oil reservoir having a greater opening diameter than that of the oil dropping hole.

3. The internal combustion engine according to claim 1, wherein the oil channel is arranged to have a downward inclination toward the driving gear.

4. The internal combustion engine according to claim 1, wherein the oil guided by the oil channel drop onto an engaging portion between the driving gear and a transmission gear receiving the driving force of the internal combustion engine.

5. The internal combustion engine according to claim 4, wherein the driving gear and the transmission gear rotate so that each direction of rotation thereof is a direction in moving away from the cylinder head.

6. The internal combustion engine according to claim 4, wherein the transmission gear is mounted on a generator arranged adjacent to the internal combustion engine, and the generator is configured to supply generated power to at least one of a battery or a motor.

* * * * *